United States Patent [19]

Savitt

[11] 4,112,845

[45] Sep. 12, 1978

[54] APPARATUS FOR DETONATING ACROSS A GAP

[75] Inventor: Jacob Savitt, Capitola, Calif.

[73] Assignee: The United States of America as represented by the Secretary of the Navy, Washington, D.C.

[21] Appl. No.: 709,577

[22] Filed: Jul. 28, 1976

[51] Int. Cl.[2] ..... C06C 5/06

[52] U.S. Cl. ..... 102/27 R

[58] Field of Search ..... 102/27 R, 27 I, 70 R

[56] References Cited

U.S. PATENT DOCUMENTS

| | | | |
|---|---|---|---|
| 2,424,374 | 7/1947 | Taylor et al. | 102/27 R |
| 3,150,590 | 9/1964 | Silverman | 102/21.6 |
| 3,205,818 | 9/1965 | Coulson | 102/27 R |
| 3,326,127 | 6/1967 | Schimmel | 102/27 R |
| 3,460,477 | 8/1969 | Heidemann et al. | 102/27 R |
| 3,707,917 | 1/1973 | Zernow et al. | 102/27 R |
| 3,945,322 | 3/1976 | Carlson et al. | 102/27 R |

FOREIGN PATENT DOCUMENTS

| | | | |
|---|---|---|---|
| 1,180,037 | 12/1958 | France | 102/27 R |
| 1,208,737 | 9/1959 | France | 102/27 R |

*Primary Examiner*—Verlin R. Pendegrass

*Attorney, Agent, or Firm*—R. S. Sciascia; Charles D. B. Curry; Francis I. Gray

[57] ABSTRACT

Detonation of an acceptor charge by a donor charge across an intervening gap where the two charges are not axially aligned is achieved by shaping the respective charges to control the direction of the fragments of the donor charge and their impact pattern upon the acceptor charge.

4 Claims, 9 Drawing Figures

FIG _ 1
(PRIOR ART)
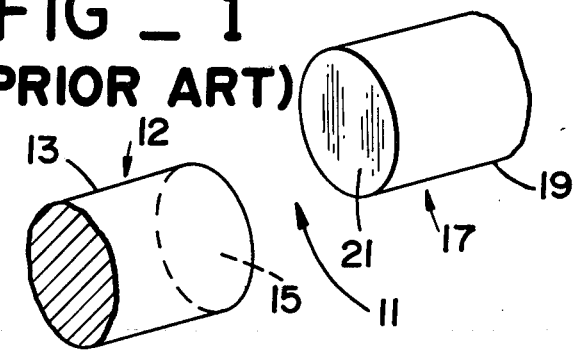
FIG _ 2
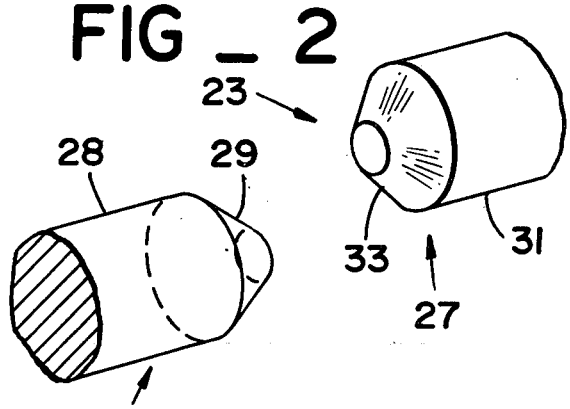
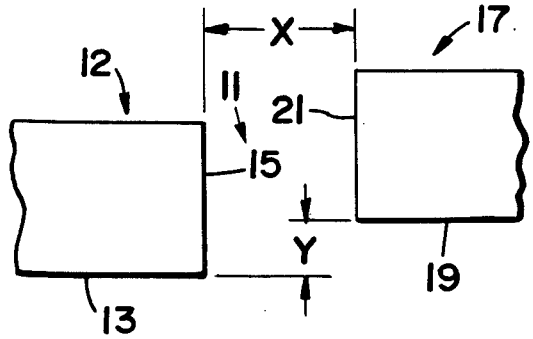
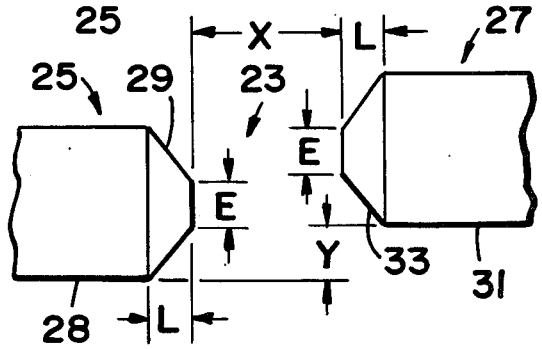
FIG _ 1A (PRIOR ART)
FIG _ 2A
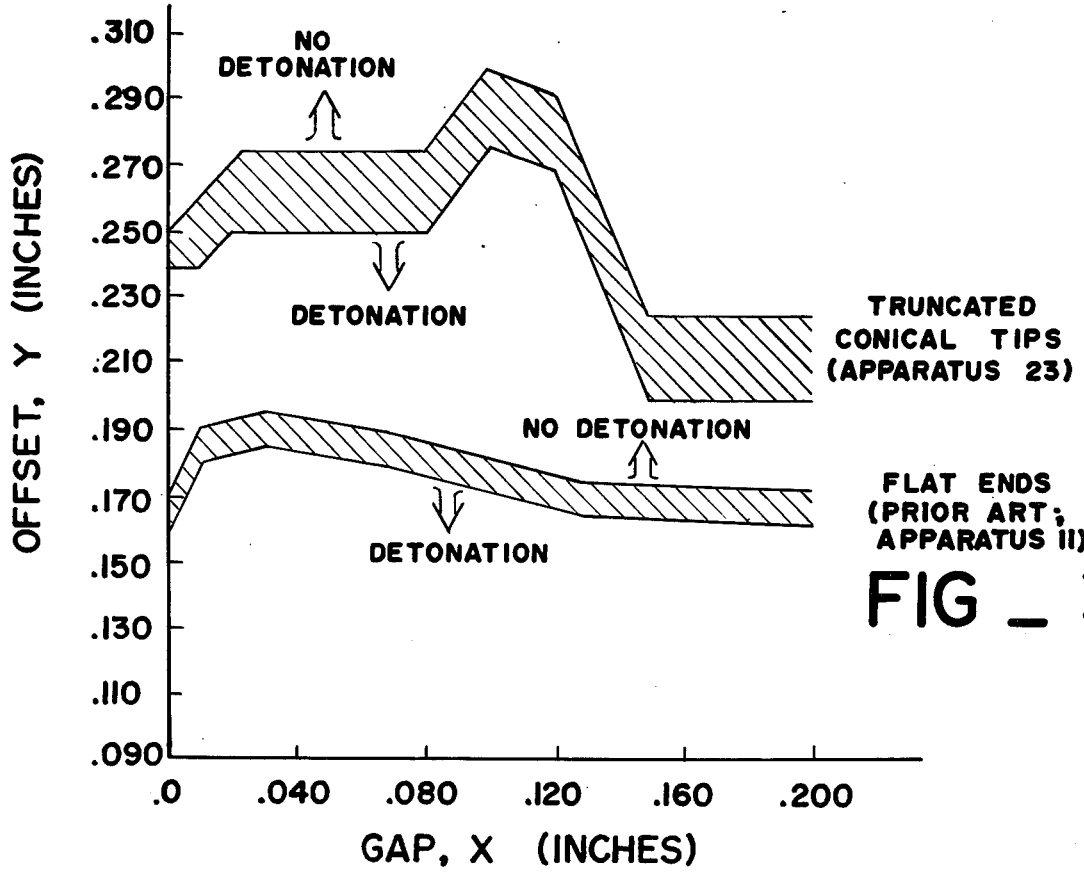
FIG _ 3

APPARATUS FOR DETONATING ACROSS A GAP

BACKGROUND OF THE INVENTION

1. Field of the Invention

This invention relates to detonators, and more particularly to an apparatus for reliably achieving detonation when there is a gap between the donor and acceptor charges and they are not in axial alignment.

2. Description of the Prior Art

The basic problem is that of obtaining the detonation of a second charge (the acceptor) upon the detonation of a first charge (the donor) where the two charges are separated by a gap or by a barrier and a gap and are axially offset from each other, i.e., they are not in perfect axial alignment. Detonation of the acceptor is achieved by the impact of the fragments of the exploded casing of the donor upon the acceptor casing with sufficient velocity and in a high enough density pattern. Thus the axial and lateral components of the distance separating the two charges are key variables because of their direct effect upon the aforementioned impact velocity and pattern.

Presently, detonators are typically comprised of donor and acceptor charges that are cylindrically shaped with flat ends that face each other. To ensure reliable detonation of the acceptor charge, it is desirable to axially align the two charges, i.e., position the axis of in the revolution of the two cylinders on the same line. However, operative vibration, structural design constraints, and random error occurring in assembly often cause misalignment, i.e., offset, between the two.

Assembly errors are dealt with by tightening the tolerances and simply absorbing the reduction in production rate and concomitant increase in unit cost. Another approach is to increase the explosive charge of the donor. This increases the possibility of damage to surrounding structures and components and may necessitate the installation of protective shielding for such, thus increasing the weight, a crucial design variable in flight vehicles. A third technique is to increase the target area of the acceptor charge. Structural design constraints may negate this possibility; also, this approach will increase the explosive charge of the acceptor and thus the problem of providing shielding to avoid potential damage to adjacent structures and components arises.

In addition, detonation across a gap and with a considerable angle between the respective axes of revolution of the donor and acceptor charge cylinders, e.g., around a corner, is currently highly unreliable.

The present invention increases the reliability of transmitting detonation from one charge to another across an intervening gap or barrier when the two charges are not axially aligned by shaping the tip of the donor charge to cause its casing fragments to disperse with a significant radial as well as axial velocity component. The tip of the acceptor charge is also shaped in order to increase the impact density of the casing fragments originating from the tip of the donor charge.

Through the use of the present invention, detonation may reliably be obtained around corners as well as for virtually any angular orientation between two or more separated charges.

SUMMARY OF THE INVENTION

The present invention transmits detonation from one charge to another across an intervening gap even when the two charges are not in axial alignment. Such is accomplished by shaping the opposing tips of the charges to provide the casing fragments of the donor charge tip with a radial velocity component and also to increase the impact density of such fragments upon the tip of the acceptor charge.

STATEMENT OF THE OBJECTS OF THE INVENTION

An object of the present invention is to reliably provide detonation of one charge by another charge.

Another object of the present invention is to provide detonation of one charge by another charge across an intervening gap.

Still another object of the present invention is to provide detonation of one charge by another charge across an intervening gap when the two charges are not axially aligned with each other.

Yet another object of the present invention is to provide detonation of one charge by another charge when the two charges are not positioned parallel to each other.

A further object of the present invention is to provide detonation of one charge by another charge when the two charges are located perpendicular to each other.

Another object of the present invention is to reliably provide simultaneous detonation of a plurality of charges by a single charge.

Other objects, advantages and novel features of the invention will become apparent from the following detailed description of the invention when considered in conjunction with the accompanying drawings wherein:

BRIEF DESCRIPTION OF THE DRAWINGS

FIGS. 1 and 1A show perspective and side views, respectively, of the detonation apparatus of the prior art comprised of two charges being cylindrically shaped and having flat opposing ends;

FIGS. 2 and 2A show perspective and side views, respectively, of one embodiment of the present invention comprised of two charges of cylindrical shape with truncated conical tips;

FIG. 3 is a graph based upon test firings comparing the performance of the truncated conical tip embodiment of the present invention with the flat tip configuration of the prior art;

DESCRIPTION OF THE PREFERRED EMBODIMENTS

Figure 4:
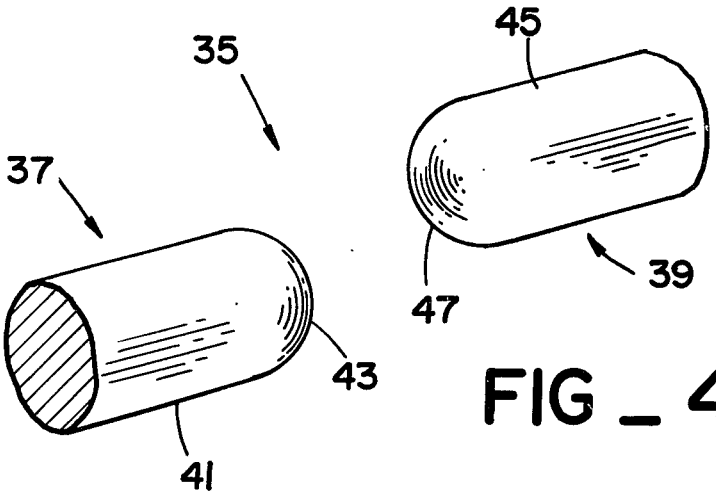
FIG. 4 shows a side view of another embodiment of the present invention comprised of two charges of cylindrical shape with hemispherical tips.

FIGS. 1 and 1A, respectively, show perspective and side views of prior art detonator apparatus 11. Apparatus 11 comprised of donor charge 12 composed of cylindrical body casing 13 and flat end 15 and acceptor charge 17 composed of cylindrical body casing 19 and flat end 21, both containing explosive material (not shown). Ends 15 and 21 are axially separated by gap X.

The axes of revolution of cylindrical body 13 and cylindrical body 19 are parallel and laterally offset by distance Y. In operation, the detonation of donor charge 12 will cause fragments of the casing from end 15 to impact upon end 21 of acceptor charge 17 and thereby cause charge 17 to detonate. The probability that the detonation of charge 12 will be transmitted to charge 17 (or vise versa) is reduced as X and Y are increased.

FIGS. 2 and 2A, respectfully, show perspective and side views of apparatus 23 comprising one embodiment of the present invention. Apparatus 23 is comprised of donor charge 25 and acceptor charge 27.

Donor charge 25 is composed of cylindrical casing 28 and truncated conical tip casing 29, both containing explosive material (not shown). Acceptor charge 27 is composed of cylindrical casing 31 and truncated conical tip casing 33, both containing explosive material (not shown). As shown with respect to the prior art in FIGS. 1 and 1A, X denotes the axial separation of charges 25 and 27, while Y denotes the lateral offset between the parallel axes of revolution of cylindrical casings 28 and 31.

It has been found that shaping the tips of the charge casings in the form of truncated cones increases the radial velocity component of fragments of tip casing 29 upon the detonation of charge 25 and also serves to increase the impact density of such fragments on tip casing 33. This has the effect of increasing the maximum offset Y at which detonation of acceptor 27 will reliably occur at any given gap X over that of the prior art.

This improvement in reliability over the prior art is shown in the graph comprising FIG. 3, the data points of which were obtained from tests of apparatus 23 of the present invention and from comparison tests conducted using prior art apparatus 11.

The upper pair of lines illustrates the performance of apparatus 23 of the present invention at various offsets, Y, and gaps, X, and the bottom pair shows the performance of prior art detonator apparatus 11. For each pair, respectively, the upper of the two lines indicates the maximum value of Y for which acceptor detonation could possibly occur for each X, i.e., the probability that a detonation of the acceptor will occur at a particular X for a Y greater than the upper line is remote. The lower line of each pair shows the maximum value of Y for each X for which detonation of the acceptor will reliably occur. The cross-sectioned area in-between shows the values of Y for which the probability of acceptor detonation is not precisely determined.

FIG. 3 clearly indicates that the embodiment of the present invention having a truncated conical tip shape, i.e., apparatus 23, will achieve reliable detonation at an appreciably larger offset Y over a range of gaps varying from 0.0 through 0.200 of an inch compared to prior art apparatus, i.e., apparatus 11.

With respect to both the donor and acceptor charges of both tested apparatus.

(1) the casing was constructed of stainless steel;
(2) the casing thickness was 0.005 of an inch;
(3) hexanitrostilbine (HNS) was the explosive material; and
(4) the casing diameter was of 0.190 of an inch.

With respect to the tested configuration of apparatus 23 of the present invention, the interior diameter E of tips 29 and 33 was 0.050 of an inch and the tip lengths L were both 0.050 of an inch.

It should be noted that the maximum reliable detonation curve, i.e., of the lower curve of each pair, is dependent upon the casing material, casing thickness, explosive material, and casing diameter. However, it has been found that for a given set of such variables the curve for an appropriately shaped tip of the present invention will provide a higher maximum reliable offset Y for every feasible operative gap X than the corresponding curve for the apparatus of the prior art, i.e., apparatus 11.

FIG. 4 shows detonation apparatus 35, an embodiment of the present invention comprised of donor charge 37 and acceptor charge 39. Donor charge 37 is comprised of cylindrical casing 41 and hemispherical tip casing 43, both enclosing explosive material (not shown). Acceptor charge 39 is comprised of cylindrical casing 45 and hemispherical tip casing 47, both containing explosive material (not shown).

It has been found that using hemispherical shaped tips 43 and 47 increases the reliability of achieving detonation across the gap separating charges 37 and 39 in the illustrated situation where cylinder casings 41 and 45 are at a skewed angle with respect to each other. i.e., where the axes of revolution of cylinder casings 41 and 45 are not parallel.

Figure 5:
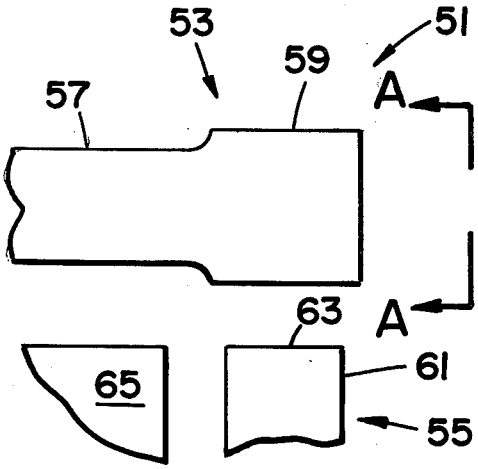
FIG. 5 is a side view of another embodimet of the present invention illustrating how it may be used to achieve detonation around a corner by using a donor charge with a tip having a rectangular cross section and an acceptor charge having a flat end.

FIG. 5 shows a side view of apparatus 51, an embodiment of the present invention which has been found to provide reliable detonation around corners, i.e., in situations where the donor and acceptor charges are perpendicular to each other. Apparatus 51 is comprised of donor charge 53 and acceptor charge 55.

Donor charge 53 is comprised of cylindrical casing 57 and rectangular tip casing 59, both filled with explosive material (not shown). Acceptor charge 55 is comprised of cylindrical casing 61 having flat end 63, and encloses an explosive material (not shown). (Acceptor charge 55 may also have a rectangular shaped tip having a flat end.)

Figure 5A:
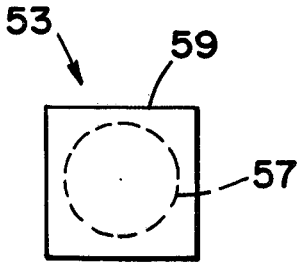
FIG. 5A is a frontal view of the donor charge.

FIG. 5A is a frontal view of donor charge 53 taken along line AA of FIG. 5; it illustrates the rectangular cross section of tip casing 59.

Apparatus 51 is shown in a typical operational application of providing detonation around corner 65. Such is accomplished by the rectangular shape of tip casing 59 of charge 53 which, when used in conjunction with flat end 63 of charge 55, provides exploded fragments of tip casing 59 with an appreciable velocity component normal to the surface of end 63 and ensures a sufficient density of impact of such particles upon end 63 to thereby detonate charge 55.

Figure 6:
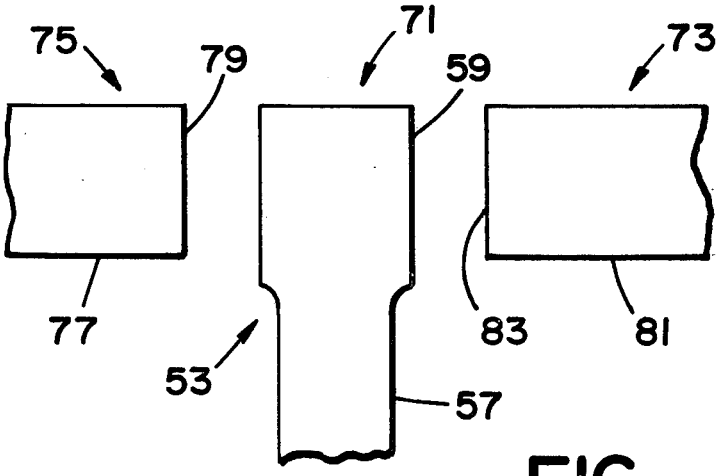
FIG. 6 illustrates a T-shaped layout whereby a donor charge with a tip having rectangular cross section may be used to simultaneously detonate two acceptor charges having flat ends.

FIG. 6 shows apparatus 71, an embodiment of the present invention which is used to simultaneously detonate two acceptor charges with one donor charge. Apparatus 71 is comprised of donor charge 53 and acceptor charges 73 and 75.

Donor charge 53 is comprised of cylindrical casing 57 and rectangular tip casing 59 and was previously discussed in detail in conjunction with apparatus 51 (shown in FIGS. 4 and 4A). Acceptor charge 75 is comprised of cylindrical casing 77 having flat end 79. Acceptor charge 73 is comprised of cylindrical casig 81 having flat end 83; both cylindrical casings 77 and 81 are filled with explosive material (not shown). (Acceptor charges 73 and 75 may also have the rectangular shaped tip having a flat end.)

When donor charge 53 is detonated, it propels fragments of casing 59 radialy relative to the axis of revolution of cylindrical casing 53 and, therefore, normal to both flat ends 79 and 83. The normal velocity component of such casing fragments and their high impact density upon ends 79 and 83 is sufficient to cause the simultaneous detonation of acceptor charges 75 and 73, respectively.

It should be noted that in all of the embodiments hereinbefore disclosed as well as any other shapes that are within the scope of the present invention, the operative roles of donor and acceptor charges may be reversed. It is also within the scope of the present invention to use a plurality of acceptor charges with any given donor charge, the respective shapes being dependent upon the orientaion of the charges as dictated by the particular operational usages and such shapes not being limited to those specifically disclosed herein.

What is claimed is:

1. An apparatus for detonating across a gap comprising:

(a) a donor charge of an explosive material in a tubular casing (b) an acceptor charge of an explosive material in a tubular casing; and (c) means for causing detonation of said acceptor charge by said donor charge across said gap therebetween when said charges are misaligned from each other, said means being end tips on each of said donor and acceptor charges of non-cylindrical configuration, the configuration of said end tips being a function of the misalignment between said donor charge and said acceptor charge.

2. The apparatus as recited in claim 1 wherein said end tips are truncated cones with the axis of revolution of each being about parallel to that of the other to compensate for the axes of said donor charge and said acceptor charge being offset but parallel relative to each other.

3. The apparatus as recited in claim 1 wherein said end tips are hemispheres to compensate for the axes of said donor charge and said acceptor charge being skewed relative to each other.

4. An apparatus for detonating across a gap comprising:

(a) a donor charge having a cylindrical tubular casing with an end tip of a right parallelepiped configuration, said casing enclosing explosive material; and (b) an acceptor charge having a tubular casing with a planar end, said casing enclosing explosive material, said planar end being oriented parallel to a face of said end tip so that detonation of said acceptor charge occurs across said gap when there is a considerable angle between the axes of said donor charge and said acceptor charge.

* * * * *